US008056522B1

(12) United States Patent
Carter

(10) Patent No.: US 8,056,522 B1
(45) Date of Patent: Nov. 15, 2011

(54) AUTOMOTIVE VALVE COVER

(76) Inventor: Gary Mikle Carter, Arvada, CO (US)

( * ) Notice: Subject to any disclaimer, the term of this patent is extended or adjusted under 35 U.S.C. 154(b) by 184 days.

(21) Appl. No.: 12/462,636

(22) Filed: Aug. 6, 2009

(51) Int. Cl.
*F01M 9/10* (2006.01)

(52) U.S. Cl. ..... 123/90.38; 123/193.5; 123/195 C

(58) Field of Classification Search ..... 123/90.38, 123/193.3, 193.5, 195 C, 198 E
See application file for complete search history.

(56) References Cited

U.S. PATENT DOCUMENTS

| | | | | |
|---|---|---|---|---|
| 3,882,834 | A | 5/1975 | Goloff | |
| 4,388,898 | A | 6/1983 | Larson | |
| 4,495,903 | A | 1/1985 | Asano | |
| 4,538,560 | A | 9/1985 | Alden | |
| 4,608,950 | A * | 9/1986 | Payne et al. | 123/195 C |
| 4,788,950 | A | 12/1988 | Finley | |
| 5,095,860 | A | 3/1992 | Newell | |
| 5,311,847 | A | 5/1994 | Boehning | |
| 5,896,837 | A | 4/1999 | Nysten | |
| 6,098,583 | A * | 8/2000 | Gordon | 123/90.38 |
| 6,382,158 | B1 | 5/2002 | Durnen | |
| 6,491,014 | B1 | 12/2002 | Eickert | |
| 6,591,930 | B2 | 7/2003 | Coughlin | |
| 7,343,890 | B1 | 3/2008 | Platt | |
| 7,389,760 | B2 | 6/2008 | Fogolini | |
| 2002/0112684 | A1 | 8/2002 | Jones | |

* cited by examiner

*Primary Examiner* — Ching Chang
(74) *Attorney, Agent, or Firm* — Henry L. Smith, Jr.

(57) ABSTRACT

An exemplary embodiment includes a valve cover for automotive engines with convenient holes for adjusting the valves without removing the valve cover from the engine. Rubber plugs close the holes in the valve cover.

9 Claims, 10 Drawing Sheets

SECTION A-A

SECTION A-A

SECTION A-A

AUTOMOTIVE VALVE COVER

BACKGROUND AND TECHNICAL FIELD

One very useful embodiment of the Invention relates to the following field, although the Invention may also relate to other fields and uses. The Invention may have various embodiments and variations. A field is a valve cover for automotive engines.

DESCRIPTION OF RELATED ART

Typical of the art related to the more widely useful embodiments of the present Invention are following patents. The following examples of related art and its limitations are illustrative and not exclusive. Other limitations of the related art will become apparent to those skilled in the art upon study of the specification and drawings of this application. Other embodiments of the Invention may relate to other arts and uses.

U.S. Pat. No. 4,388,898, Jun. 21, 1983 to Larson discloses an oil containment device. U.S. Pat. No. 4,538,560, Sep. 3, 1985 to Alden discloses an internal combustion engine valve cover. U.S. Pat. No. 4,788,950, Dec. 6, 1988 to Finley discloses a quick release valve cover. U.S. Pat. No. 6,491,014, Dec. 10, 2002 to Eickert discloses a valve cover for an engine. U.S. Pat. No. 7,343,890, Mar. 18, 2008 to Platt discloses a two-piece valve cover. None of these inventions have the structure and advantages of the invention of this application.

SUMMARY

One of the more widely useful embodiments of the present Invention may be summarized as follows. This embodiment is exemplary only. Other embodiments will become apparent to those skilled in the art upon study of the specification and drawings of this application. Other embodiments of the Invention may relate to other arts and have usefulness in those arts. One aspect of the invention is a replacement valve cover for the valves of an internal combustion engine, including one in a high-powered automobile or racing automobile. These automobiles require more frequent valve adjustments. Because they run at higher RPM's and tend to loosen. The covers can be used for stock engines as well. The valve cover replaces the conventional valve cover on the engine and has several holes through which valve adjustment tools may be inserted to adjust the valves. The rocker arms are adjusted through the holes, which in turn adjusts the valve lifters. These holes are closed by several rubber plugs made of a rubber with strong resistance to heat and oil. The valve cover could be made out of cast aluminum or other materials. The valve cover is held on the engine in the same way as ordinary valve covers—by bolts. As shown in the drawings, the rubber plugs are held in the holes by a part which is hook-shaped in cross-section. The valve cover could be made of aluminum, steel, or possibly other metals. The holes in the valve cover could be made by a Computerized Numerical Control Machine, (CNC machine), but could be possibly molded/cast in the metal. The rubber plugs are resistant to oil and high temperature, and would be made of an appropriate kind of neoprene. These plugs would not soften or deform at high temperature and allow oil leaks.

PURPOSES AND ADVANTAGES

The invention may have various embodiments and variations and may be useful in different fields and for different purposes. The purposes and advantages of the more widely useful embodiments of the present invention include, but are not limited to, the following, and may include other purposes and advantages in different fields of use not listed herein:

1. Access to individual cylinders for adjustment by valve adjustment tools.
2. Simple access to perform valve adjustments.
3. Time savings and labor savings.
4. Plug removal requires no tools and literally takes seconds to remove and replace.
5. Ease of maintenance.
6. Ease of inspection for oiling and wear of valve train parts.
7. Saves money by not having to replace gaskets, because valve cover will not have to be removed.
8. Eliminates gasket and/or sealant failure when having to replace gaskets on standard valve covers.
9. Direct replacement of stock valve covers.
10. No clean up compared to when valve covers must be taken completely off for adjustment.
11. Avoids usual situation when taking off the valve cover; oil sprays everywhere when valves are adjusted while engine is running.
12. Fits first generation small block Chevy's™ from '55 to '86 and with simple aftermarket adapter will fit '87 to present year.
13 Also, design can be used for most wedge headed engines with inline valve arrangements or canted valve arrangements and overhead valve, (OHV) four and six cylinder engines with inline valve arrangements with stock and after market adjustable rocker arms.
14. Applies to both fabricated and cast aluminum and stamped steel valve covers.
15. Can be used on stock to high performance engines.
16. Excellent for new and rebuilt engines for valve adjustment.
17. No gaskets or sealant is required for replacement of plugs.
18. Rubber plug design is excellent for sealing.
19. Rubber plugs can be removed and replace an infinite number of times for each valve adjustment.
20. Rubber plugs can be removed one at a time, and there is less chance that contaminants and particles could enter the engine (compared to removing the entire engine cover) and cause premature engine wear.

REFERENCE NUMERALS IN DRAWINGS

| | |
|---|---|
| 1. | box-shaped valve cover structure |
| 2. | valve cover lip |
| 3. | valve cover raised portion |
| 4. | adjustment holes |
| 5. | round hole |
| 6. | bolt holes |
| 7. | bolt indentation |
| 8. | bolt reinforcement |
| 9. | plug |
| 10. | plug teeth |
| 11. | engine |
| 12. | adjustment wrench |
| 13. | valve spring |
| 14. | adjusting nut |
| 15. | rocker arm |
| 16. | push rod |
| 17. | rocker arm stud |
| 18. | feeler gauge |
| 19. | outside engine valve area |

BRIEF DESCRIPTION OF THE DRAWINGS

This Brief Description and the Detailed Description Of The Drawings cover only some embodiments of the Invention, and other embodiments will be clear to those skilled in the art from the description, drawings, and Alternative and Additional Embodiments, etc. The Drawings are illustrative and not limiting.

DETAILED DESCRIPTION OF THE DRAWINGS

Figure 1:
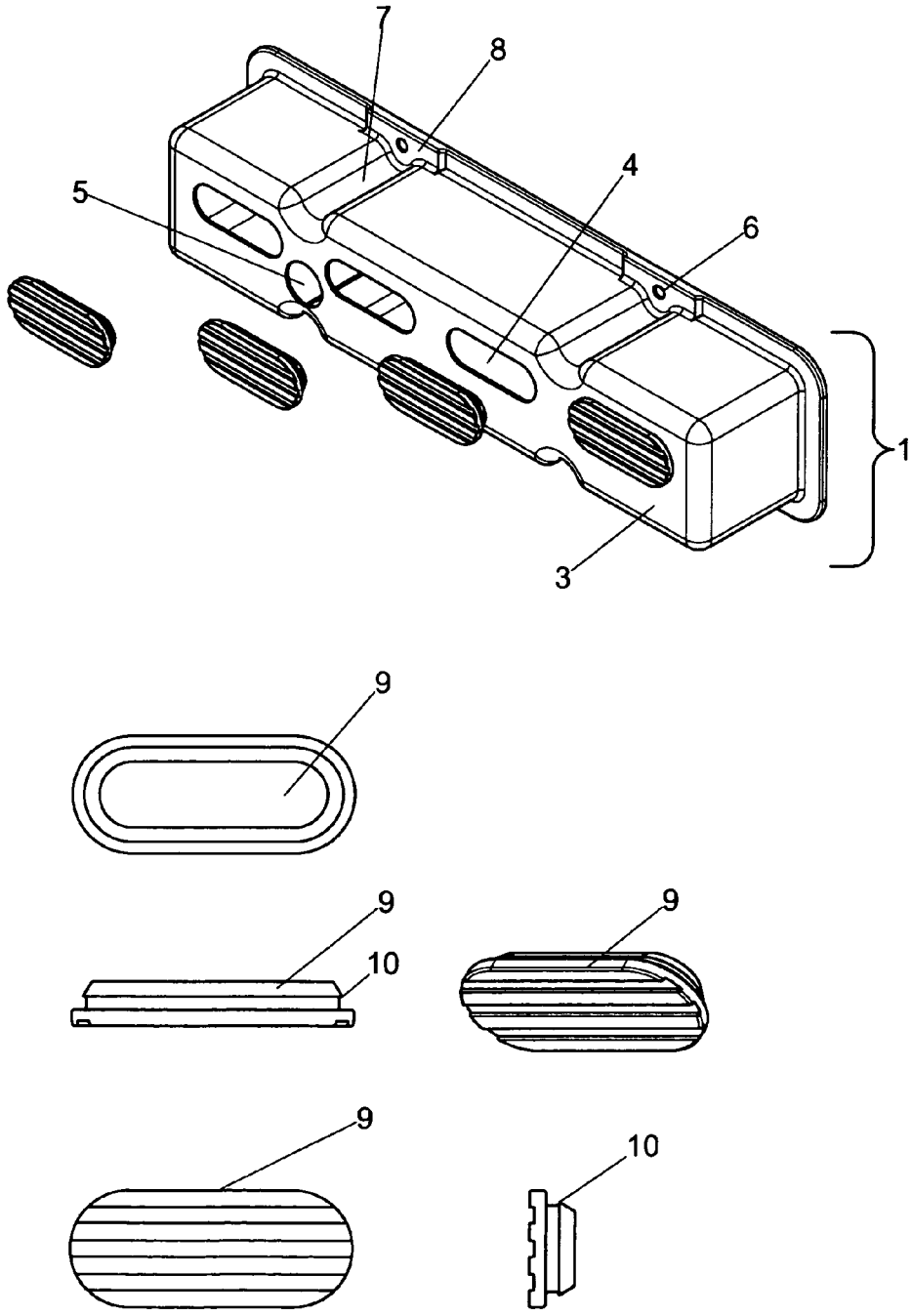
FIG. 1 shows the valve cover and several views of the rubber plugs

FIG. 1 shows the box shaped valve cover structure 1 with a valve cover lip 2, valve cover raised portion 3, adjustment holes 4, round hole 5, bolt hole 6, bolt indentation 7 and bolt reinforcement 8. Also shown are several views of plugs 9 and plug teeth 10. In this Figure and others, the rubber plugs 9 have longitudinal grooves on the outside surface. This is purely for artistic design. Many ornamental designs can be used.

Figure 2:
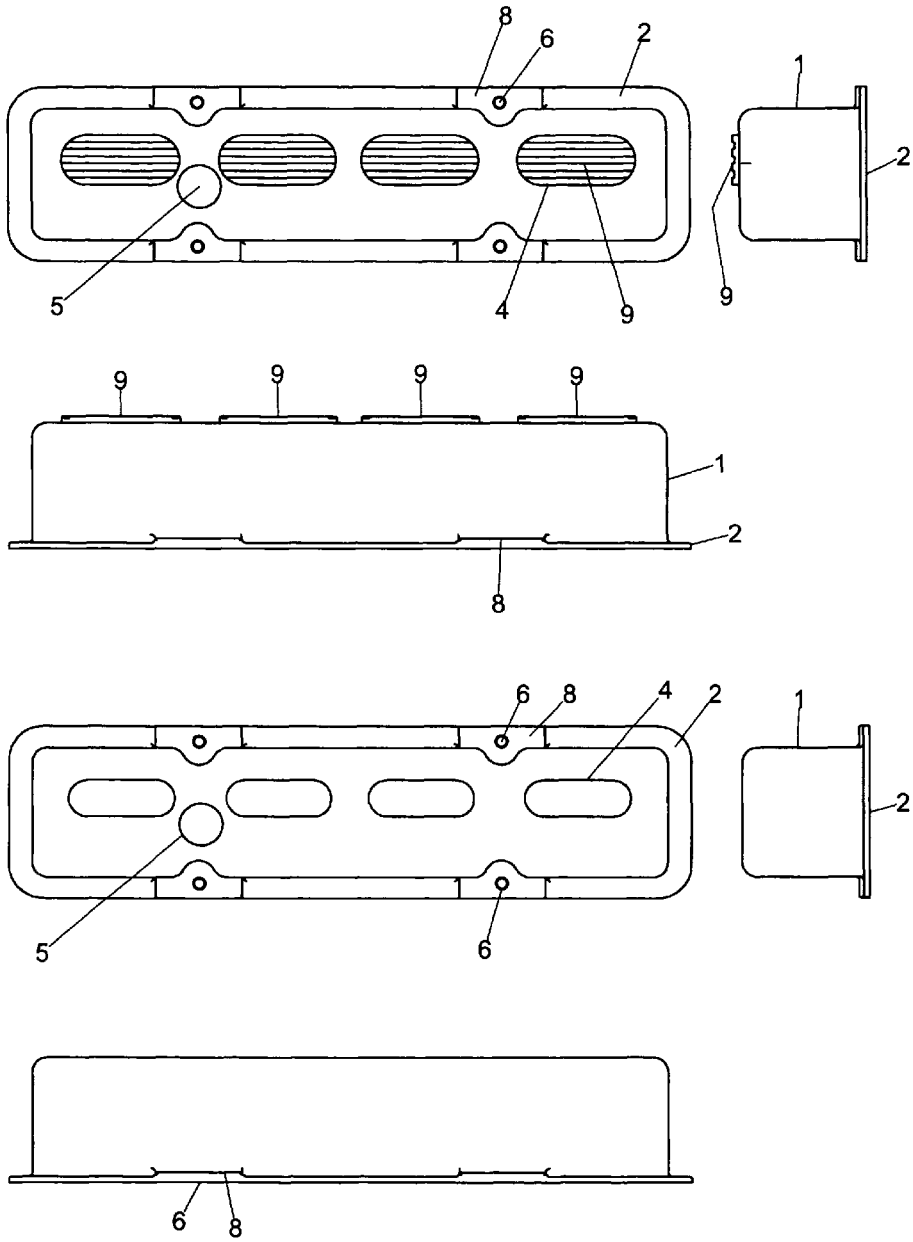
FIG. 2 shows top and side views of the valve cover with and without plugs in the adjustment holes.

FIG. 2 and other Figures show the round hole 5. The round hole is for a vent oil cap or PCV valve. This is standard on valve covers. On this valve cover the hole is lower and off center from the standard valve covers. This is so the adjustment access holes to the valve train are in-line with the adjustment nut and also for clearances for the rubber plug and grommet for the round hole. There is only one round hole because one needs only one on the left valve cover and one on the right valve cover. FIG. 2 at the top shows a top view of valve cover 1 with parts previously labeled in FIG. 1. In FIG. 2, the second drawing down is a side longitudinal view of valve cover 1 with plugs 9 inserted. FIG. 2, third drawing down, on the far right, shows the rounded edge of valve cover 1. Also shown in the third drawing down is a top view of valve cover 1 without the plugs 9. The bottom drawing in FIG. 2 is a side longitudinal view of valve cover 1 without the plugs, as shown immediately above. This Figure shows bolt reinforcement area 8. The cover is thicker around the bolt holes 6 where the hold down bolts go through. This is standard on most valve covers.

Figure 3:
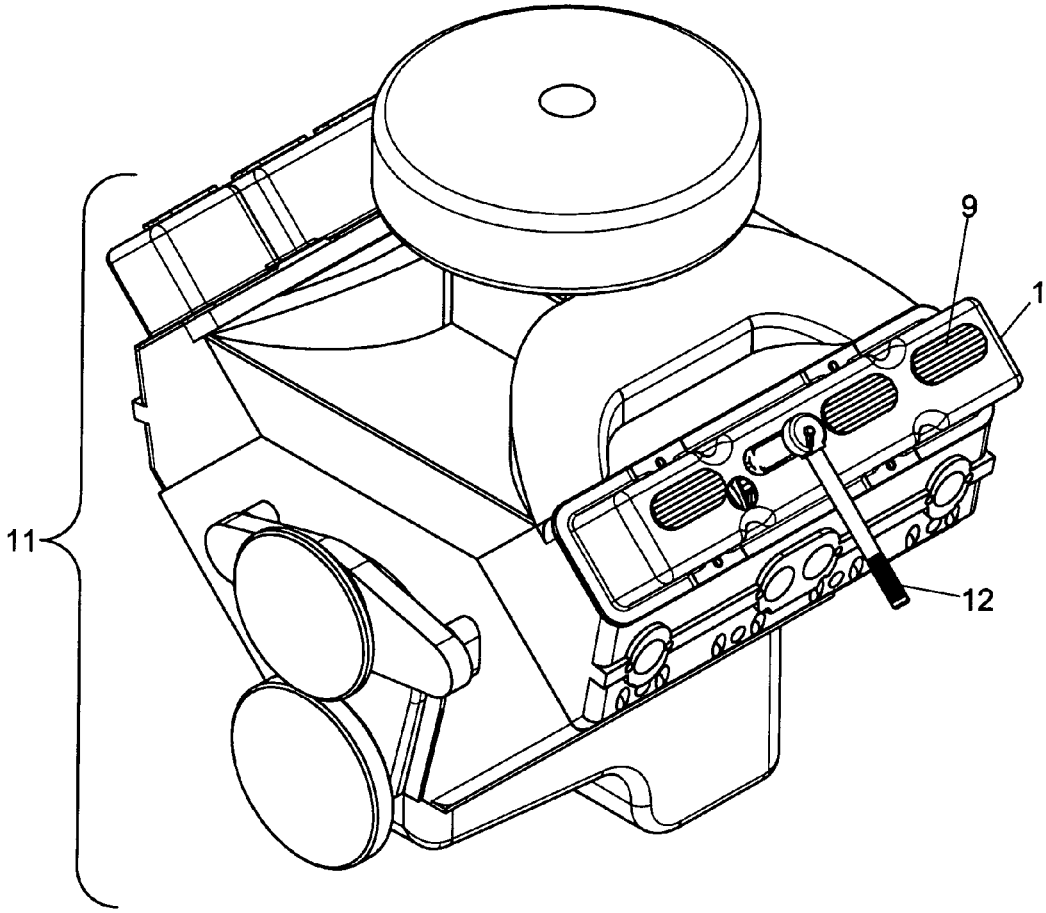
FIG. 3 shows the valve cover in place on an engine, with one plug removed so that adjustment wrench can go through the adjustment hole and adjust the valve parts, not shown.

FIG. 3 shows an engine 11 with valve cover 1 attached, and rubber plugs 9 in place except for one plug, where adjustment wrench 12 goes through one hole to adjust the valves beneath the valve cover 1, not shown.

Figure 4:
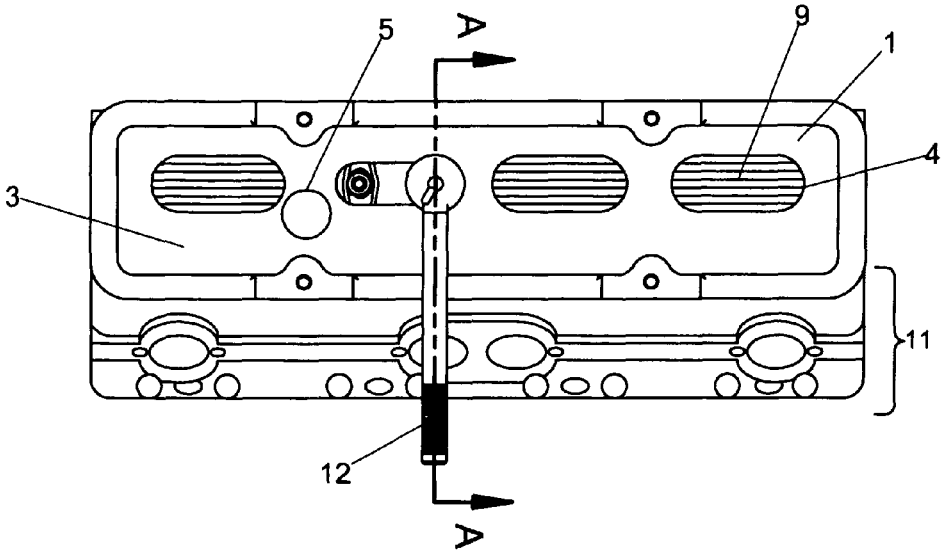
FIG. 4 at the top shows the valve cover in place on the engine with one plug removed so that the adjustment wrench can go through one adjustment hole and adjust the valve parts. Section A-A shows the adjustment wrench extending through one adjustment hole in the valve cover and in place for adjustment of the valve parts.
Figure 4:
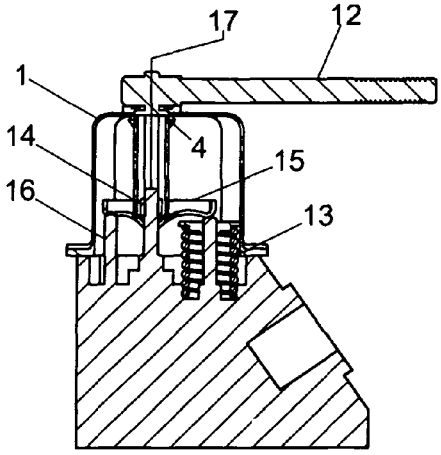

FIG. 4 at the top shows the valve cover 1 in place on engine 11 and adjustment wrench 12 extending through one adjustment hole 4 where a plug 9 has been removed. Section A-A shows the adjustment wrench 12 extending through adjustment hole 4 to adjust the valves under valve cover 1. Rocker arm stud 17, pushrod 16, rocker arm 15, and valve springs 13 are also shown.

Figure 5:
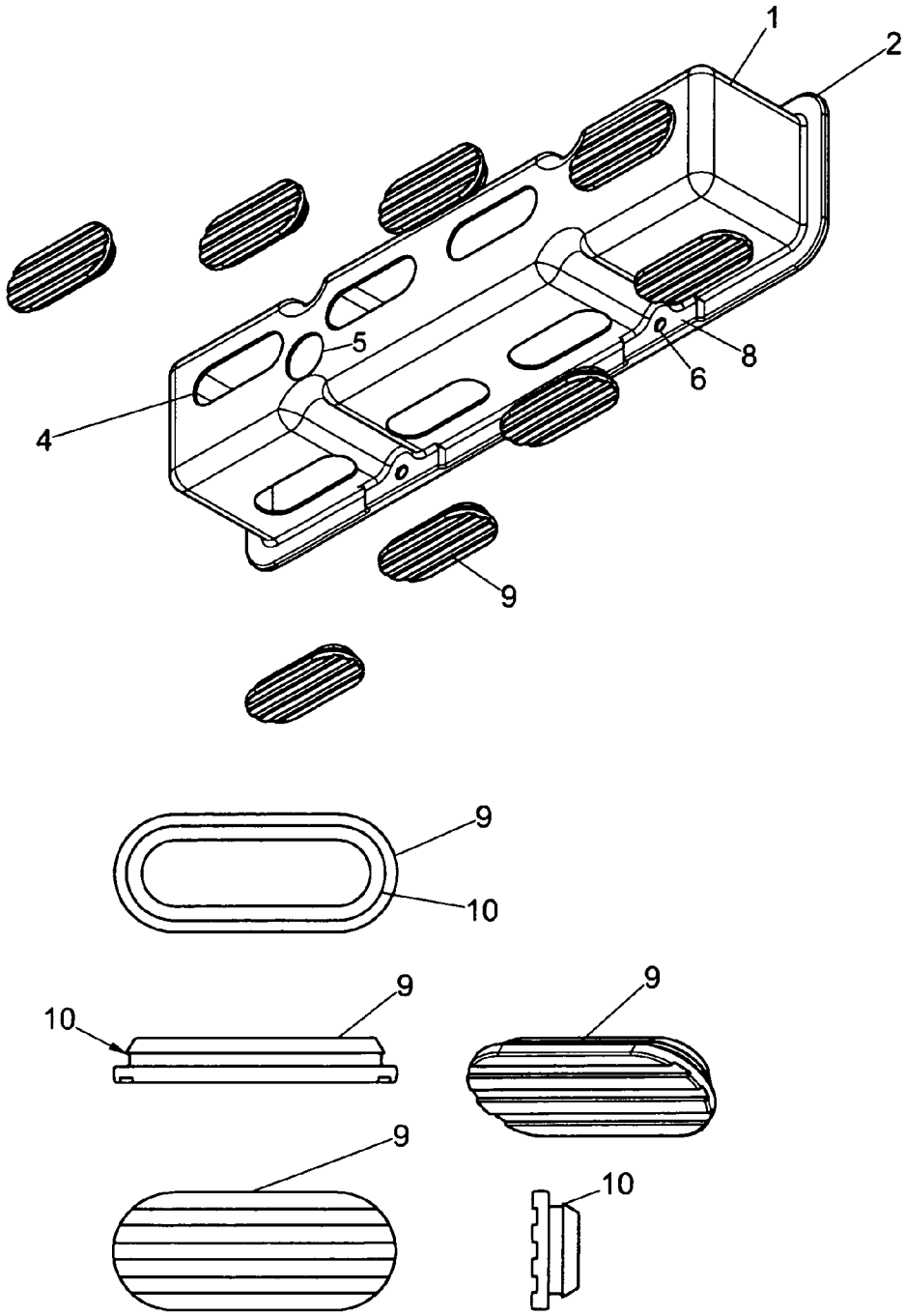
FIG. 5 shows an alternate version of the valve cover with adjustment holes on the top and also the sides, plus various views of the plugs.
Figure 5A:
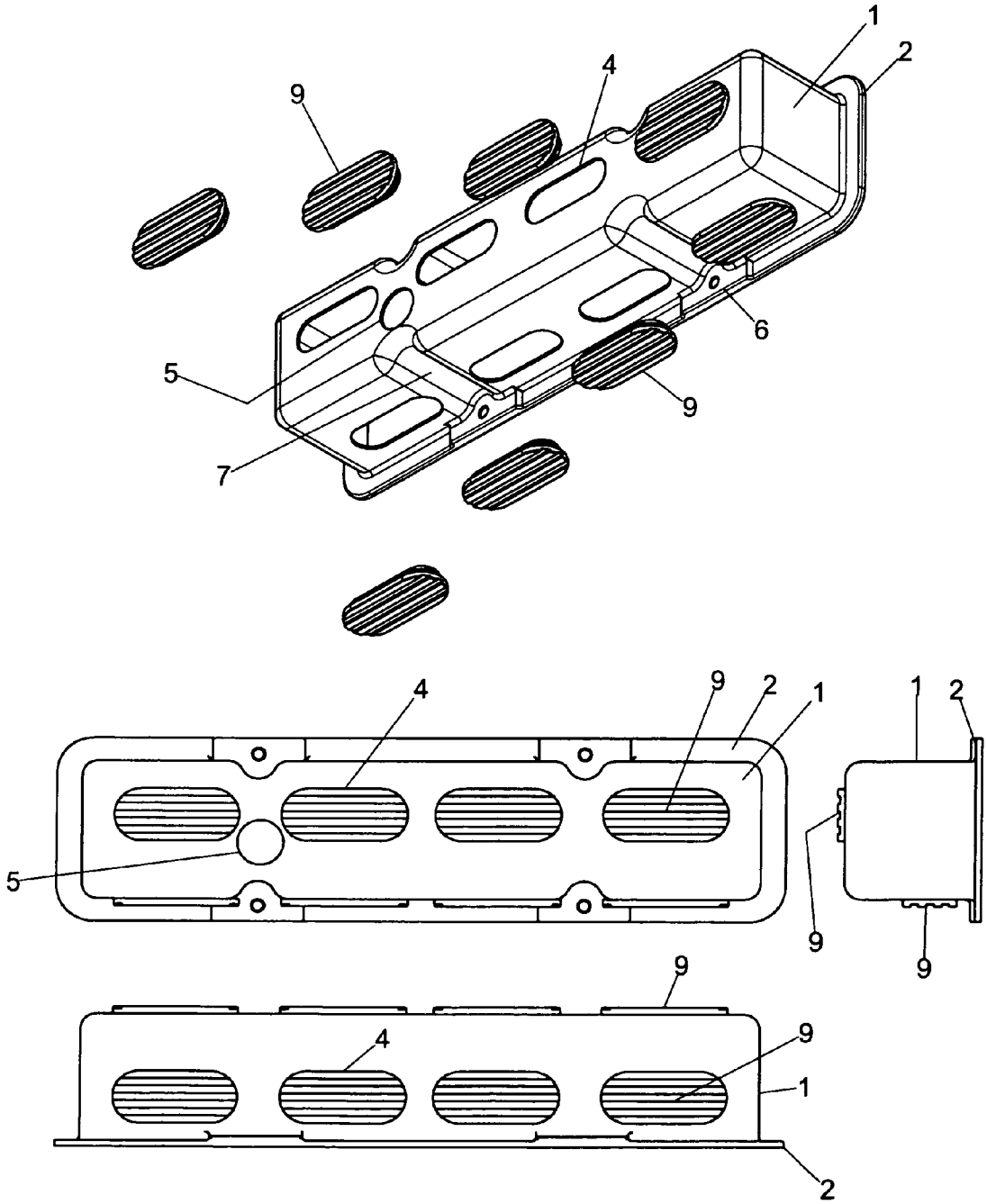
FIG. 5A is similar to FIG. 5, but shows at the bottom the plugs in place in the top and side adjustment holes

FIG. 5 is similar to previous Figures except that a version of valve cover 1 is shown which has adjustment holes 4 on the top and also on the side surfaces. Plugs 9 are shown in various views along with plug teeth 10. FIG. 5A is similar to FIG. 5 except that it shows plugs 9 in place in the adjustment holes 4 in both the top and side surfaces of valve cover 1.

Figure 6:
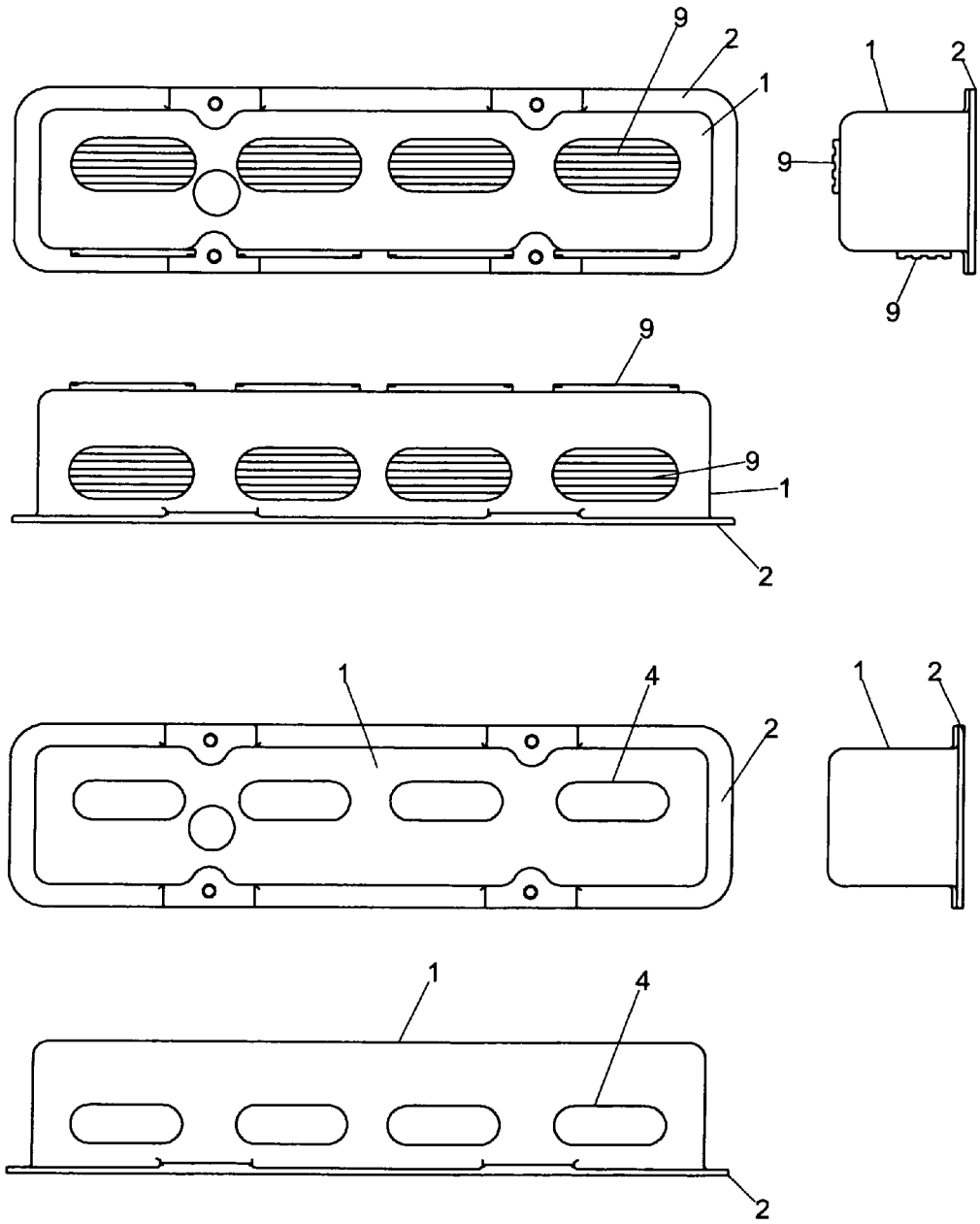
FIG. 6 is similar but shows plugs in place in the adjustment holes in the top and side of the valve cover.
Figure 6A:
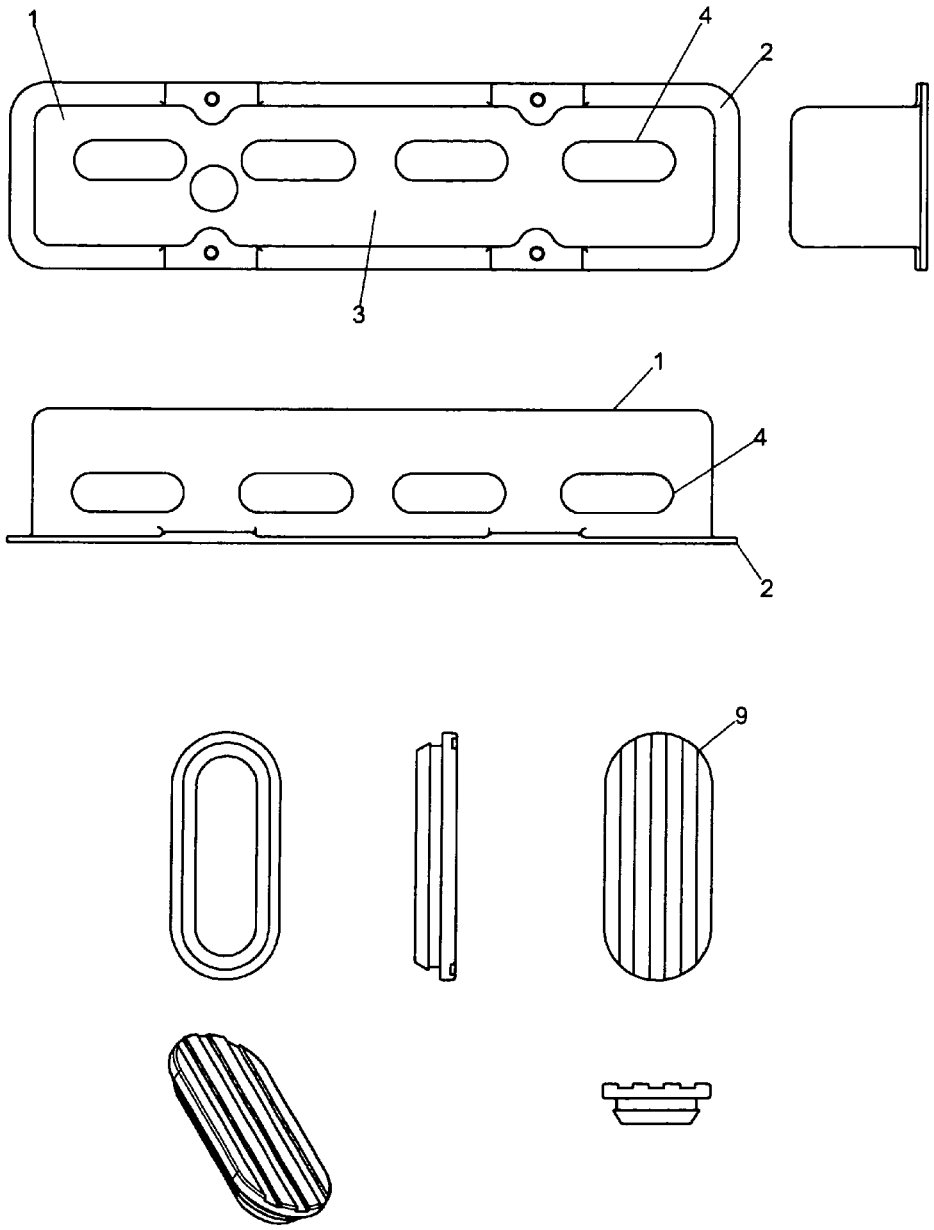
FIG. 6A shows the version with adjustment holes in the top and side of the valve cover, and, at the top, a view looking down on the top of the valve cover with the adjustment holes in the top surface, and below that a side view of the valve cover with the adjustment holes in the side of the valve cover. Also shown are various views of the plugs; clockwise from the noon position: side view, top view, end view, perspective top view, and bottom view.

FIG. 6 is essentially the same as FIG. 2 but it shows a version of the valve cover 1 with adjustment holes 4 on both the top and side surfaces. FIG. 6A shows the version with adjustment holes 4 in the top and side of the valve cover 1, and, at the top, a view looking down on the top of the valve cover 1 with the adjustment holes 4 in the top surface, and below that a side view of the valve cover with the adjustment holes 4 in the side of the valve cover. Also shown are various views of the plugs; clockwise from the noon position: side view, top view, end view, perspective top view, and bottom view.

Figure 7:
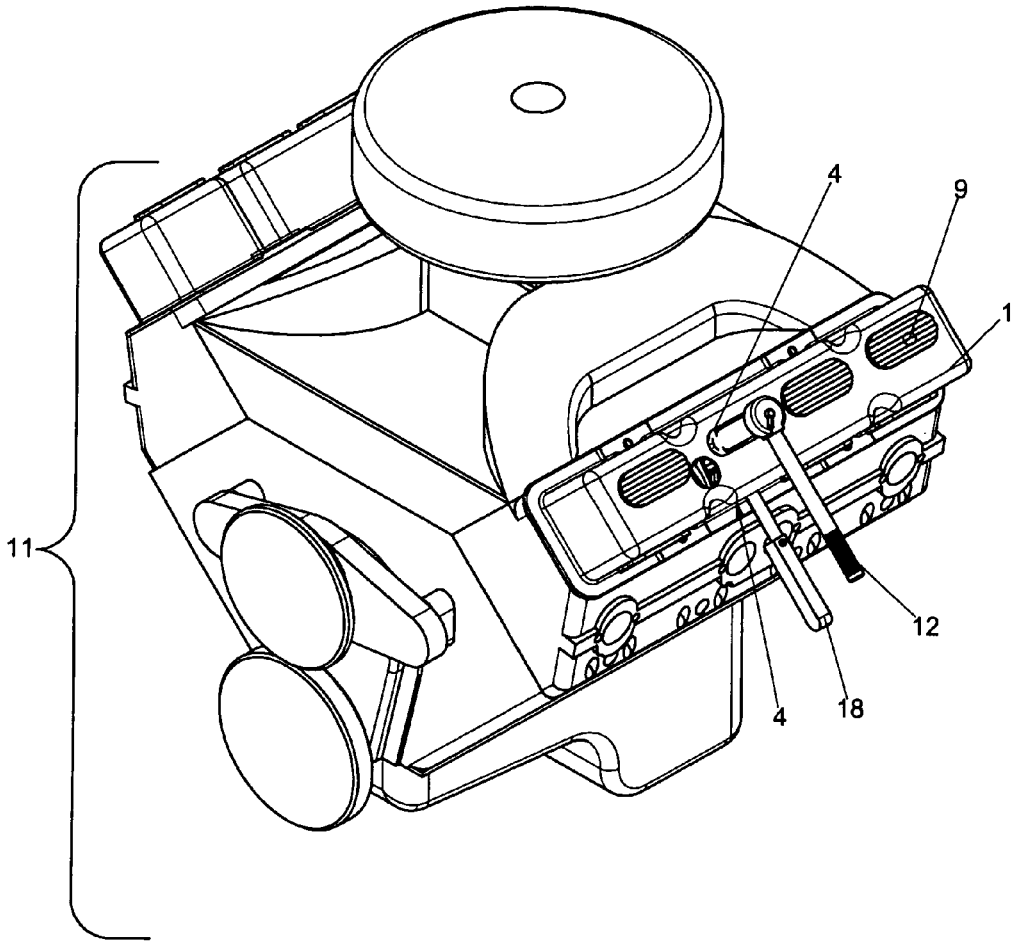
FIG. 7 shows the valve cover in place on the engine with plugs in 3 of the 4 adjustment holes, one plug removed so that the adjustment wrench can go in the hole. The feeler gauge 18 is shown inserted in a side hole in the valve cover to gauge the gap dimension.

FIG. 7 shows an engine 11 with valve cover 1 in place on it and one top plug 9 removed so that adjustment wrench 12 can extend through adjustment hole 4, and so that feeler gauge 18 can extend in a side adjustment hole 4 to adjust the valve clearance.

Figure 8:
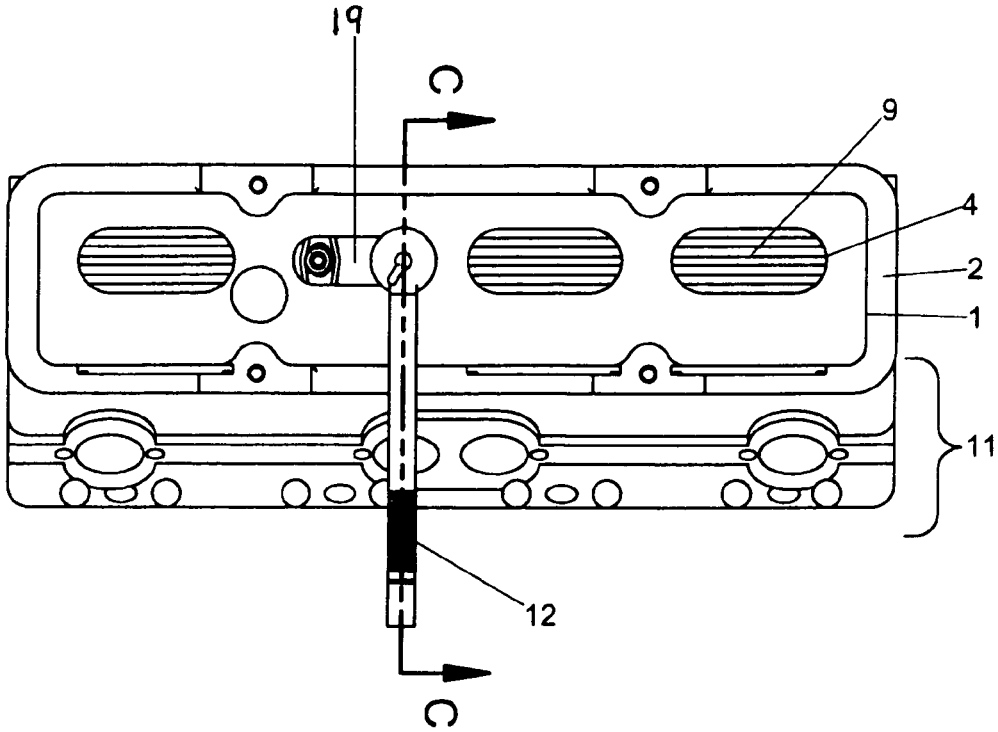
FIG. 8 is similar to FIG. 4, but it shows the adjustment wrench placed through an adjustment hole in the top of the valve cover, and a feeler gauge placed through a side adjustment hole in the valve cover.
Figure 8:
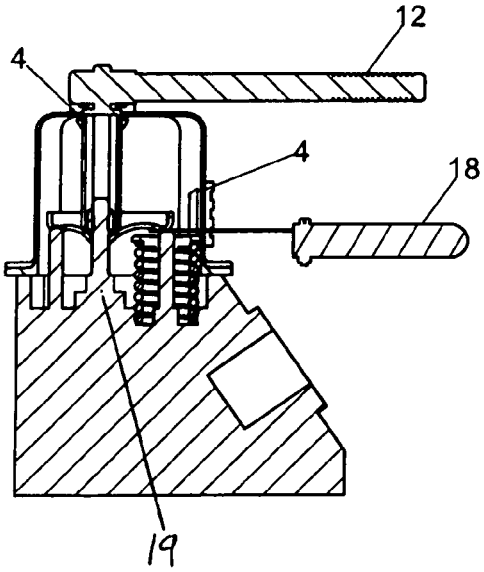

FIG. 8 at the top is similar to the drawing at the top of FIG. 4, and at the bottom Section A-A shows the feeler gauge 18 extending through a side adjustment hole 4 for adjustment of the valve clearance.

DESCRIPTION

Preferred Embodiment

The following embodiments of the Invention shown in the Figures are the embodiments presently preferred by the Inventor, but over time other embodiments and uses in other areas may become preferred to those skilled in the art.

The dimensions of the valve cover and holes could vary, but typical dimensions would be: holes 1.07 by 3.06 inches; space between holes 1.49 to 1.1 inches; lip of valve cover 3.85 inches by 18.44 inches; raised portion of valve cover 2.99 inches by 17.58 inches.

Operation of One Embodiment

FIG. 1 shows the valve covers with the openings on the top for hydraulic flat tappet cams and hydraulic roller cams. The adjustments will be made through the top only. The valve adjustment tool is inserted through the top access openings for access to the adjusting nut.

FIG. 4 Section A-A shows the adjustments being made through the top access. FIG. 3 shows the engine with the adjustment tool through the top access.

FIG. 5 shows the valve covers with the openings on the top and side for solid lifters cams and solid roller cams. The adjustments will be made through the top and side. The valve adjustment tool is inserted through the top access openings for access to the adjusting nuts, while the feeler gauge will be inserted through the side holes.

FIG. 8 Section A-A shows the adjustments being made through the top and side access.

FIG. 7 shows the engine with the adjustment tool through the top access with the feeler gauge through the side access.

The plugs stay the same for both types of valve covers.

Tests of One Embodiment

Tests were run in May of 2009. While testing the engine at idle to 5000 revolutions per minute, there wasn't any oil pumped out of the valve cover while the top plugs were removed. Valve adjustments were made through the adjustment access holes, without removing the valve cover, while the engine was running with oil remaining within the head. When the rubber plugs were in place the seal was excellent.

Additional Embodiments

Design variations may include different shaped access openings with different shaped rubber plugs. (The size, shape and location of the openings will be self limiting.) Variations in color and graphics for the rubber plugs.

The rubber plugs could have billet covers that would be removable.

Rubber plugs could be connected for removal of all plugs at once.

The rubber plugs could be reinforced.

Rubber plugs could be made thicker or thinner.

The valve cover could have designs or could be different colors.

Alternative Embodiments

Valve covers can be made with the rubber plugs for access to valve trains for v-8, v-six, straight six and four cylinder engines with adjustable type valve train.

Conclusions, Ramifications and Scope

A number of changes are possible to the methods, parts, and uses described above while still remaining within the scope and spirit of the Invention. The specifics about the form and use of the Invention described in this application (including the specifics in the Summary, Abstract, Preferred Embodiment, Additional Embodiments, and Alternative Embodiments, etc.) are examples and are not intended to be limiting in scope. Those skilled in the art will recognize certain modifications, permutations, additions, subtractions and sub-combinations thereof, and may discover new fields of use. The scope of the Invention is to be determined by the claims and their legal equivalents, not the examples, purposes, summary, preferred embodiments, alternative or additional embodiments, operation, tests, parameters, or limitations etc. given above. It is intended that the claims are interpreted to include all such modifications, additions, subtractions, permutations and sub-combinations as are within their true spirit and scope, including those which may be recognized later by those skilled in the art.

I claim:

1. A box-shaped valve cover structure for an internal combustion engine having adjustable valves, comprising:

(a) a substantially rectangular, box-shaped structure having a substantially rectangular cross-section along its long axis, and a substantially square cross-section along its short axis, (b) an opening on one side of the structure in place of one long rectangular surface of the rectangular box-shaped structure, (c) one or more adjustment holes in the long rectangular surface of the structure opposite to the opening in (b) wherein the one or more adjustment holes comprise less than 20% of the area of that long rectangular surface, (d) a lip around the perimeter of the opening in (b) sized and shaped for mounting on the outside engine valve area of an internal combustion engine, and (e) one or more plugs sized and shaped to removably fill the one or more adjustment holes in (c), whereby an adjustment wrench can be placed through an adjustment hole to adjust a valve of an internal combustion engine without removing the valve cover structure from the engine.

2. The valve cover structure of claim 1, wherein the lip includes one or more bolt holes through which a bolt can pass for securing the valve cover structure to the outside engine valve area of an internal combustion engine.

3. The valve cover structure of claim 2, wherein the one or more plugs are substantially flat and further comprise one or more plug teeth around the perimeter of the plug, whereby the plug teeth can engage the perimeter of the adjustment holes and hold the plugs removably but securely in the adjustment holes.

4. The valve cover structure of claim 3, further comprising one or more substantially round holes in the rectangular surface containing the adjustment hole or holes.

5. A box-shaped valve cover structure for an internal combustion engine having adjustable valves, comprising:

(a) a substantially rectangular, box-shaped structure having a substantially rectangular cross-section along its long axis, and a substantially square cross-section along its short axis, (b) an opening on one side of the structure in place of one long rectangular surface of the rectangular box-shaped structure, (c) one or more adjustment holes in the long rectangular surface of the structure opposite to the opening in (b), (d) one or more adjustment holes in a long rectangular surface of the structure at right angles to the opening in (b), and (e) a lip around the perimeter of the opening in (b) sized and shaped for mounting on the outside engine valve area of an internal combustion engine, wherein the one or more adjustment holes comprise less than 40% of the area of the long rectangular surfaces in (c) and (d), whereby an adjustment wrench can be placed through an adjustment hole in (c) to adjust a valve of an internal combustion engine, and whereby a feeler gauge can be inserted through a hole in (d) for measuring the valve clearance of a valve of an internal combustion engine, without removing the valve cover structure from the engine.

6. A box-shaped valve cover structure for an internal combustion engine having adjustable valves, comprising:

(a) a substantially rectangular, box-shaped structure having a substantially rectangular cross-section along its long axis, and a substantially square cross-section along its short axis, (b) an opening on one side of the structure in place of one long rectangular surface of the rectangular box-shaped structure, (c) one or more adjustment holes in the long rectangular surface of the structure opposite to the opening in (b), (d) one or more adjustment holes in a long rectangular surface of the structure at right angles to the opening in (b), (e) a lip around the perimeter of the opening in (b) sized and shaped for mounting on the outside engine valve area of an internal combustion engine, and (f) one or more plugs sized and shaped to removably fill the one or more holes in (c) and (d), wherein the one or more adjustment holes comprise less than 40% of the area of the long rectangular surfaces in (c) and (d), whereby an adjustment wrench can be placed through an adjustment hole in (c) to adjust a valve of an internal combustion engine, and whereby a feeler gauge can be inserted through a hole in (d) for measuring the valve clearance of a valve of an internal combustion engine, without removing the valve cover structure from the engine.

7. The valve cover structure of claim 6, wherein the lip includes one or more bolt holes through which a bolt can pass for securing the valve cover structure to the outside engine valve area of an internal combustion engine.

8. The valve cover structure of claim 7, wherein the one or more plugs are substantially flat and further comprise one or more plug teeth around the perimeter of the plug, whereby the plug teeth can engage the perimeter of the adjustment holes and hold the plugs removably but securely in the adjustment holes.

9. The valve cover structure of claim 8, further comprising one or more substantially round holes in the rectangular surface containing the adjustment hole or holes.

* * * * *